US006439692B1

(12) United States Patent
Misumi

(10) Patent No.: US 6,439,692 B1
(45) Date of Patent: Aug. 27, 2002

(54) INK JET RECORDING APPARATUS AND DRIVING METHOD THEREOF USING A FLOW RESISTANCE ELEMENT TO PROMOTE COLLAPSE OF A GENERATED BUBBLE

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/560,342

(22) Filed: Apr. 28, 2000

Related U.S. Application Data

(62) Division of application No. 08/140,963, filed on Oct. 25, 1993, now Pat. No. 6,244,693, which is a continuation of application No. 07/716,832, filed on Jun. 17, 1991, now abandoned.

(30) Foreign Application Priority Data

Jun. 15, 1990 (JP) ..... 2-157004
Jun. 15, 1990 (JP) ..... 2-157005

(51) Int. Cl.[7] ..... B41J 2/04
(52) U.S. Cl. ..... 347/54
(58) Field of Search ..... 347/65, 63, 61, 347/56, 94, 12, 13, 57, 40, 54, 20; 399/237, 258, 260

(56) References Cited

U.S. PATENT DOCUMENTS

| | | | |
|---|---|---|---|
| 4,313,124 | A | 1/1982 | Hara |
| 4,338,611 | A | 7/1982 | Eida |
| 4,345,262 | A | 8/1982 | Shirato et al. |
| 4,459,600 | A | 7/1984 | Sato et al. |
| 4,463,359 | A | 7/1984 | Ayata et al. |
| 4,492,482 | A | 1/1985 | Eguchi et al. |
| 4,558,333 | A | 12/1985 | Sugitani et al. |
| 4,723,129 | A | 2/1988 | Endo et al. |
| 4,723,136 | A | 2/1988 | Suzumura |
| 4,740,796 | A | 4/1988 | Endo et al. |
| 4,810,111 | A | 3/1989 | Sogami et al. |
| 4,882,595 | A | 11/1989 | Trueba et al. |
| 4,897,674 | A | 1/1990 | Hirasawa |

FOREIGN PATENT DOCUMENTS

| | | | |
|---|---|---|---|
| EP | 0 124 311 | 7/1984 | |
| EP | 0 314 486 | 3/1989 | |
| EP | 0 318 328 | 5/1989 | |
| EP | 0 423 797 | 4/1991 | |
| EP | 461940 | * 12/1991 | ..... 347/65 |
| FR | 2520532 | 7/1983 | |
| JP | 54-56847 | 5/1979 | |
| JP | 54-100169 | 8/1979 | |
| JP | 0100169 | 7/1980 | |
| JP | 55-109672 | 8/1980 | |
| JP | 59-123670 | 7/1984 | |
| JP | 59-138460 | 8/1984 | |
| JP | 59-138461 | 8/1984 | |
| JP | 60-71260 | 4/1985 | |
| JP | 0037438 | 2/1986 | |
| JP | 61-40160 | 2/1986 | |

OTHER PUBLICATIONS

Asai, Akira et al. "One–Dimensional Model of Bubble Growth and Liquid Flow in Bubble Jet Printers", *Japanese J. Appl. Phys.*, vol. 26, No. 10 (Oct. 1987), pp. 1794–1801.

* cited by examiner

*Primary Examiner*—Raquel Yvette Gordon
(74) *Attorney, Agent, or Firm*—Fitzpatrick, Cella, Harper & Scinto

(57) ABSTRACT

An ink jet recording head includes an ejection outlet for ejecting ink; an ink passage provided corresponding to the ejection outlet; a thermal energy generator to heat the ink in the passage to create a bubble; a flow resistance element, disposed in the ink passage upstream of the thermal energy generator with respect to a direction of flow of the ink, having a reduced ink passage area to divide the bubble.

2 Claims, 12 Drawing Sheets

INK JET RECORDING APPARATUS AND DRIVING METHOD THEREOF USING A FLOW RESISTANCE ELEMENT TO PROMOTE COLLAPSE OF A GENERATED BUBBLE

CROSS REFERENCE TO RELATED APPLICATIONS

This application is a division of U.S. patent appln. No. 08/140,963, filed Oct. 25, 1993, now U.S. Pat. No. 6,244,693 which is a continuation of U.S. patent appln. No. 07/716,832, filed Jun. 17, 1991, now abandoned.

FIELD OF THE INVENTION AND RELATED ART

The present invention relates to an ink jet recording head, an ink jet recording apparatus and a driving method therefor.

In a typical ink jet recording head, an electrothermal transducer is supplied with a driving signal to produce thermal energy to heat ink adjacent the ink generating portion (heater) so as to produce a change of state including bubble creation. The resultant pressure function to eject the ink. To effect this recording, the ink jet recording head comprises the electrothermal transducer (thermal energy generating element), an ink ejection outlet (orifice) and an ink passage (nozzle) communicating with the ejection outlet.

As shown in FIG. 9 the conventional ink passage generally is straight from the ejection outlet to the supply port (rear end or upstream end adjacent the common ink chamber) except the ejection outlet portion, for the purpose of smooth flowing of the ink. However, with such a structure of the ink passage, the pressure produced by the bubble creation due to the power supply to the heater transmits directly toward upstream as well as toward downstream, with respect to the direction of the ink flow (back wave).

The back wave impedes the flow of the refilling ink from the upstream, and therefore, the time required for the refilling is longer. This imposes difficulty to the high speed ink ejections.

Where the recording head has a plurality of ink passages communicating with the upstream common ink chamber, the backwave is influential to other ink passages by way of the common chamber (cross talk). So, there is a problem of instable ejection.

In addition, with the conventional ink passage, the cavitation produced at the time of extinction or collapse of the bubble significantly damages the heater with the result of lower durability, for example, $1\times10^8$ pulses per nozzle.

Japanese Laid-Open Patent Application No. 100169/1979, 40160/1986 and U.S. Pat. No. 4,882,595 propose provision of a flow resistance element at an upstream side of the ejection heater for the purpose of reducing the backwave, the vibration of the meniscus and the cross talk and the improvement in the response property. However, no consideration has been paid to the cavitation, and therefore, the sufficient service life of the heater is not achieved.

Japanese Laid-Open Patent Application No. 138460/1974 which has been assigned to the assignee of this application has proposed a recording head having an ejection outlet facing a heater surface so that the ink is ejected in the direction perpendicular to the direction of the flow of the refilling ink, wherein the ink passage wall is deformed adjacent the heater to shift the position of the bubble upon the collapse thereof to suppress the influence of the cavitation.

In this Japanese Laid-Open Application, the damage to the ink passage wall and the electrode or the like adjacent the heater still remains. Particularly in the case of the recording head wherein the ejection outlet, the heater and the ink supply port of the common chamber are disposed along a line, the ink flows to the heater upon the collapse of the bubble not only from the ink supply port (upstream) but also from the ejection side because of the retraction of the meniscus at the ejection outlet. Therefore, it is difficult to sufficiently shift the bubble collapse position from the heater.

As for the driving method for the ink jet recording head having plural heaters involves a problem that when the plural heaters are simultaneously driven, a large electric current is required, and the ink droplets ejected through the adjacent nozzles interfere with each other to degrade the print quality, as disclosed in Japanese Laid-Open Patent Application No. 109672/1980. In order to solve the problems, it has been proposed that the heaters are divided into plural groups which are driven simultaneously, respectively, thus reducing the number of the heaters simultaneously driven and thus preventing the interference between the ink droplets through the adjacent nozzles.

However, in this conventional structure, when a small number of nozzles are driven simultaneously, the refilling and the restoring of the meniscus are accomplished in a short period. However, when the number of simultaneously driven nozzles is large, they are not accomplished for a short period. In this case, the refilling frequency reduces from 8 KHz–4 KHz, approximately, for example. Usually, the minimum repeatable frequency is selected as the upper limit of the driving frequency of the recording head, and therefore, a high frequency driving, and therefore, a high speed driving is not possible.

SUMMARY OF THE INVENTION

Accordingly, it is a principal object of the present invention to provide a recording head and a recording apparatus wherein the meniscus retraction is suppressed.

It is another object of the present invention to provide a recording head and a recording apparatus wherein the backwave is reduced.

It is a further object of the present invention to provide a recording head and a recording apparatus wherein the refilling period can be reduced.

It is a further object of the present invention to provide a recording head and a recording apparatus wherein the cross talk due to the backwave is reduced.

It is a further object of the present invention to provide a recording head and a recording apparatus wherein the collapsing energy of the bubble can reduced, so that the cavitation can be reduced.

It is a further object of the present invention to provide a recording head and a recording apparatus wherein the durability of the heater, electrode and/or ink passage wall can be improved.

It is a further object of the present invention to provide a driving method wherein the nozzles are driven in a time-dividing manner, and the rest periods are properly selected so that the refilling period is reduced, by which the ejection frequency is significantly improved.

In an embodiment of the present invention, the plural heaters are divided into some groups which are driven simultaneously. After the heaters of a certain group is driven (supplied with the electric energy) to create bubbles, the heaters of the next group is supplied with the electric energy within the period from the driving of the former heater to the maximum bubble time. By doing so, the refilling period is reduced, and therefore, the driving frequency can be increased. In addition, the process from the bubble creation to the bubble collapse can be stabilized for the number of nozzles, by which the deviations of the shot positions of the ink droplets can be reduced.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
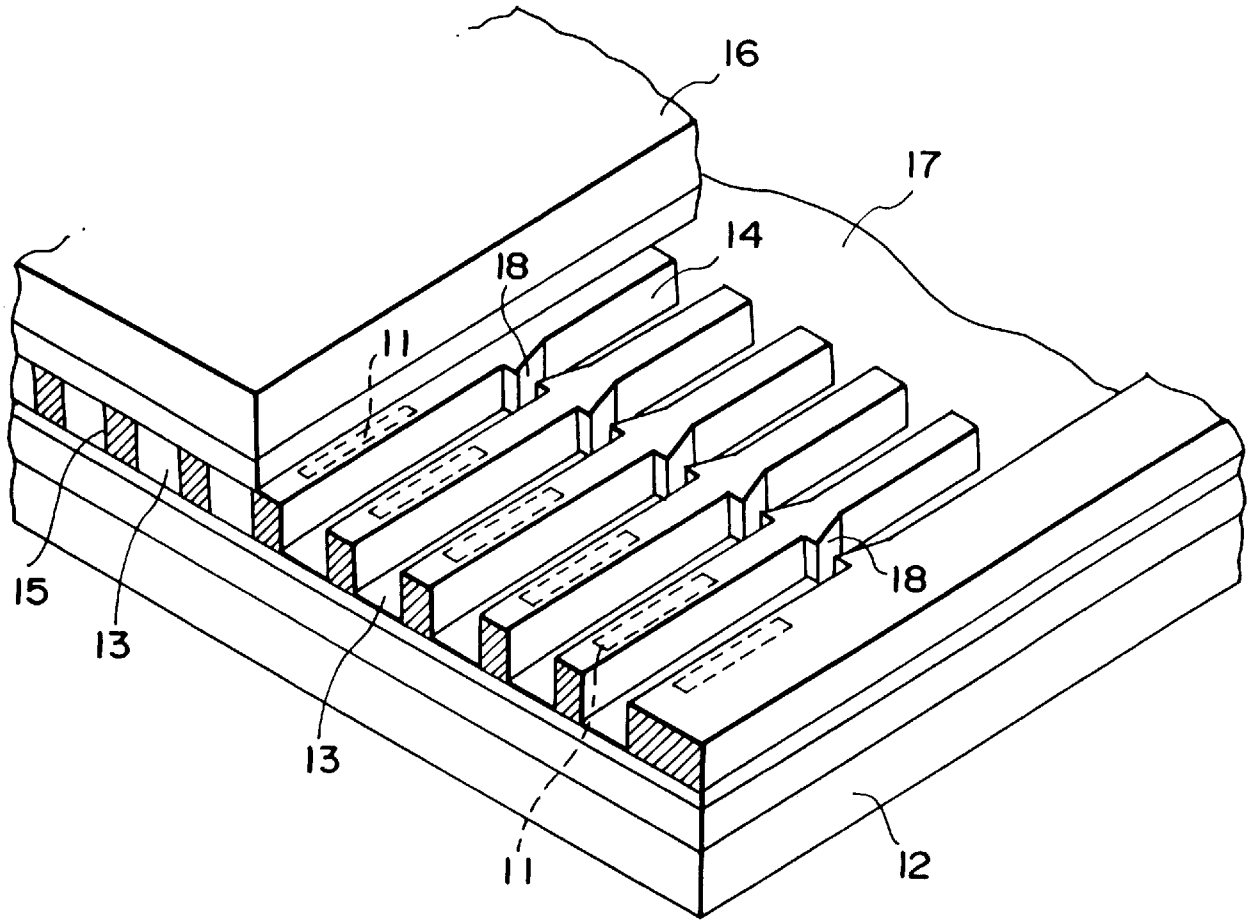
FIG. 1 is a perspective view of an ink jet recording head having a flow resistance according to an embodiment of the present invention.

FIG. 1 is a perspective view of an ink jet recording head having a flow resistance having a local narrow area at a position upstream of the heater with respect to the flow direction of the ink, that is, the position closer to a common liquid chamber.

The recording head comprises an ejection heater in the form of an electrothermal transducer (thermal energy generating element) to be supplied with electric energy (drive signal) to generate heat to create a bubble of the ink, a base plate 12 on which the heater 11 is formed through the manufacturing steps which are similar to the semiconductor manufacturing steps, an ink ejection outlet 13 (for the sake of simplicity, it is shown as having the same cross-sectional area as the passage), and an ink passage 14 communicating with the ejection outlet 13. Reference numeral 18 designates the flow resistance in the ink passage 14 to reduce the cross-sectional area of the nozzle, locally. An ink passage constituting member 15 provides the ejection outlet 13 and the ink passage 14. It further comprises a top plate 16, and an ink chamber 17 commonly communicating with a plurality of the ink passages 14.

Figure 2:
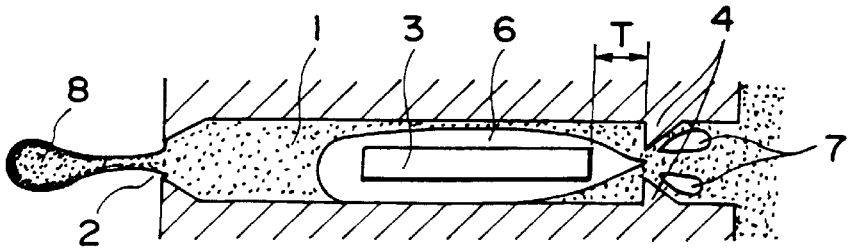
FIGS. 2 and 3 are a top sectional view and a cross-sectional view of an ink jet recording head according to an embodiment of the present invention.

FIG. 2 is a top plan view which is somewhat schematical to illustrate the function of the ink passage. In this Figure, reference numerals 1, 2, 3, 4, 6, 7 and 8 designate the ink passage (nozzle), the ejection outlet, the ejection heater, the flow resistance (concentrated flow resistance element), a bubble, separated bubble and ejected ink, respectively.

Figure 3:
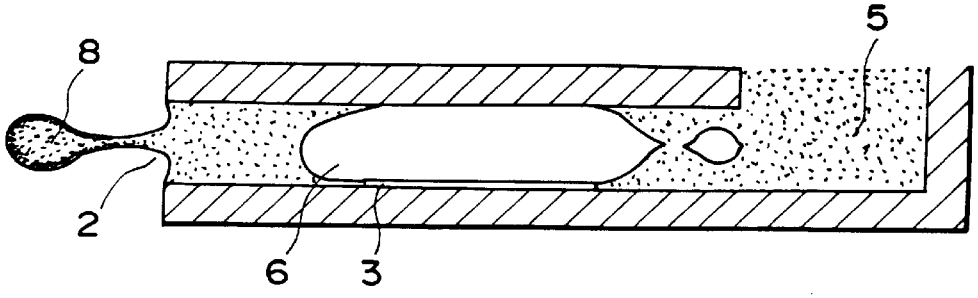

FIG. 3 is a side view of a nozzle of FIG. 2, wherein the same reference numerals are assigned to the corresponding elements and parts. A reference numeral 5 designates the common ink chamber.

Referring to FIG. 2, the thermal energy produced by the heater 3 heats the ink adjacent the heater to create a bubble. Then, since the upstream and downstream portion of the passage are linear adjacent the heater and have the constant cross-sectional areas, the created bubble expands downstream (toward the ejection outlet) and upstream (toward the common chamber). The component of the pressure in the forward direction (toward the ejection outlet) is effective to eject the ink through the ejection outlet 2. The upstream component of the pressure is impeded by the flow resistance 4. When the bubble passes through the flow resistance element 4, it is separated behind the flow resistance element 4 and remains there. The separate bubble or bubbles are collapsed there when the bubble adjacent the heater collapses after the maximum size thereof.

Figure 10:
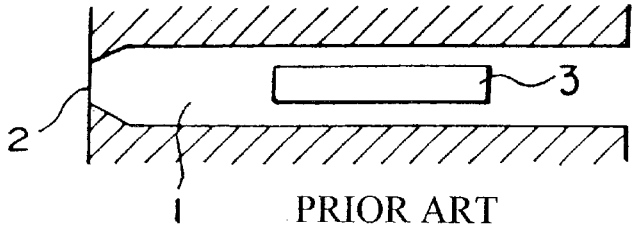
PRIOR ART FIG. 10
FIG. 10 is a top sectional view of a conventional ink jet recording head.

FIG. 10 shows a nozzle without the flow resistance element. In the case of such a nozzle, the bubble expands to the maximum size of approximately 310 microns. In the embodiment shown in FIG. 2, when, for example, the flow resistance element having a cross-sectional passage area of 327 micron$^2$ which is 30% of the nozzle cross-sectional area of 1090 micron$^2$ at a position 30 micron (T) away from the trailing edge of the heater, the bubble is divided and separated by the flow resistance element during the bubble expansions. Then, the maximum length of the bubble is 230 microns, and therefore, the damage due to the cavitation on the heater is reduced. The durability is improved by approximately 30% over the nozzle shown in FIG. 10.

In the nozzle having the flow resistance as in this embodiment, the backward impedance which is the resistance against the flow from the center of the heater toward the common ink chamber is higher than the forward impedance which is the resistance against the flow from the common ink chamber to the center of the heater.

Table 1 shows the flow resistances of the nozzle having the flow resistance element and not having it (linear nozzle) obtained through simulation.

TABLE 1

| Nozzles | Backward impedance (KPa $\mu S/(\mu m)^3$ | Forward impedance |
|---|---|---|
| with resistance | 0.0118 | 0.0054 |
| without resistance | 0.0063 | 0.0063 |

As will be understood from this Table, in the nozzle having the flow resistance, the backward impedance is high, and therefore, the speed of the ink flow toward the common chamber is low during the creation and expansion of the bubble, so that the unnecessary backflow of the ink can be suppressed. Accordingly, the quantity of the ink required for refilling the ink decreases, and the kinetic energy of the ink moving for bubble collapse immediately before the extinction of the bubble. The kinetic energy is considered as being influential to the strength of the cavitation.

The kinetic energy immediately before the extinction of the bubble which is considered influential to the strength of the cavitation is considered as being provided by potential energy of the system when the volume of the bubble is at its maximum. Therefore, the kinetic energy of the ink immediately before the extinction of the bubble can be reduced, and the cavitation can be efficiency suppressed, by providing the flow resistance element at a position where a part of the maximum bubble passes through, thus separating the bubble, and therefore, reducing the volume of the bubble on the heater.

As for a parameter influential to the strength of the cavitation, the kinetic energy of the ink in the nozzle which increase from the point of time of the maximum volume of the bubble to the point of the time of extinction of the bubble, is considered. The increases of the kinetic energy in the nozzle in this embodiment and the straight nozzle, are obtained through simulation. The results are as follows.

TABLE 2

| Nozzles | Increase of kinetic energy |
|---|---|
| with flow resistance at bubble dividing position | 1.73 nJ |
| with flow resistance not at bubble dividing position | 2.28 nJ |
| without flow resistance | 2.85 nJ |

As will be understood from Table 2, in the embodiment having the flow resistance element at a position for separating the bubble, the increase of the kinetic energy, and therefore, the strength of the cavitation is smaller than in the nozzle without the flow resistance element or the nozzle having a flow resistance element not at the position separating or dividing the bubble.

According to this embodiment, the damage to the heater, the electrode or the like due to the cavitation can be significantly reduced, because the volume of the bubble on the heater is reduced by the division of the bubble, the kinetic energy is not concentrated because there are a plurality of points of bubble extinction when the refilling ink moves toward the points of bubble extinction, and because some of the divided bubbles collapse at a position other than on the heater (upstream thereof).

Additionally, since the flow resistance element is disposed at such a position to which a part of the bubble passes upon the maximum expansion of the bubble, the length of the nozzle can be reduced, so that the flow resistance of the nozzle when the ink is refilled. This is also effective to increase the response frequency. The response frequencies are compared between the nozzle of the present embodiment and the nozzle having the flow resistance element at the position through which the bubble does not pass, as follows:

TABLE 3

| Nozzle | Response frequency |
|---|---|
| Embodiment | 6.1 kHz |
| Comparison Example | 4.8 kHz |

As will be understood, the operational frequency is significantly improved.

Figure 4:
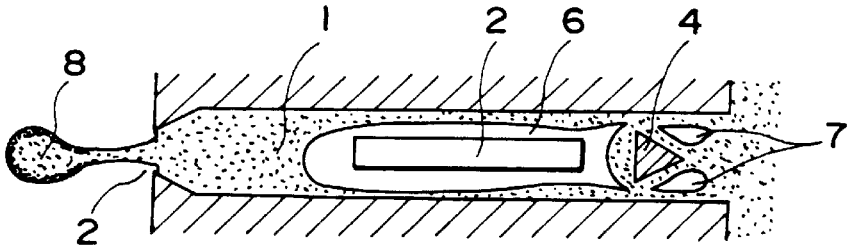
FIGS. 4 and 5 are top plan view and a sectional view of an ink jet recording head according to another embodiment of the present invention.
Figure 5:
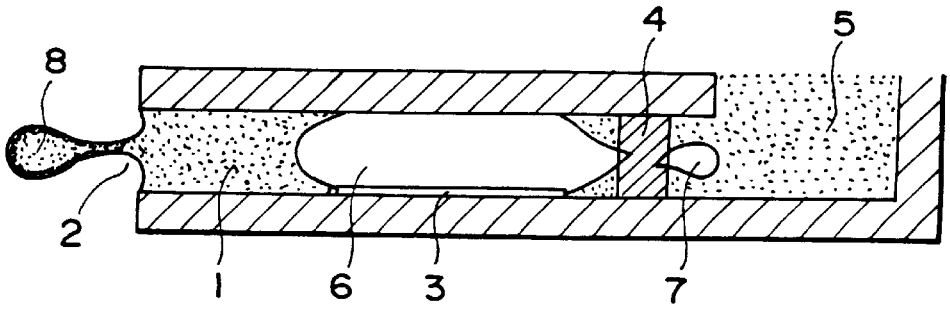

FIG. 4 illustrates a recording head according to another embodiment, wherein the flow resistance element is in the form of a column at a center of the nozzle 1, by which the flow area for the ink is reduced by 30% at the flow resistance element position. FIG. 5 is a sectional view. During the bubble expansion period, a part of the bubble passes through the flow resistance element 4 at each side thereof, by which the bubble is divided. At this time, the maximum length of the bubble is 220 microns. Similarly the foregoing embodiment, the damage to the heater or the electrode due to the cavitation upon the collapse of the bubble, is reduced, so that the durability and the refilling properties are improved.

Figure 6:
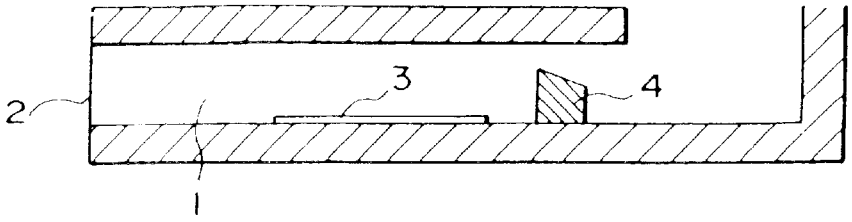
FIGS. 6, 7 and 8 are sectional views of ink jet recording heads according to further embodiments of the present invention.
Figure 7:
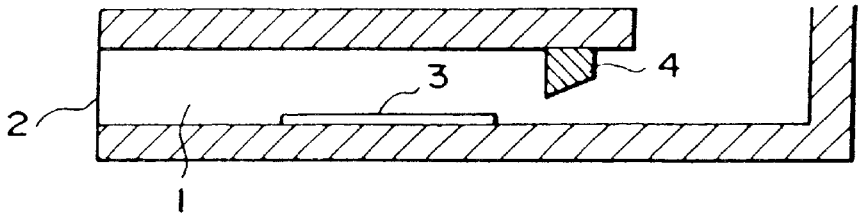
Figure 8:
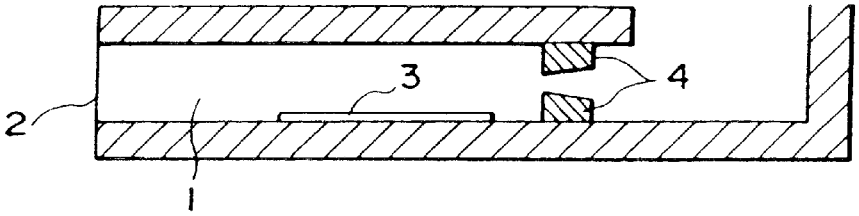
Figure 9:
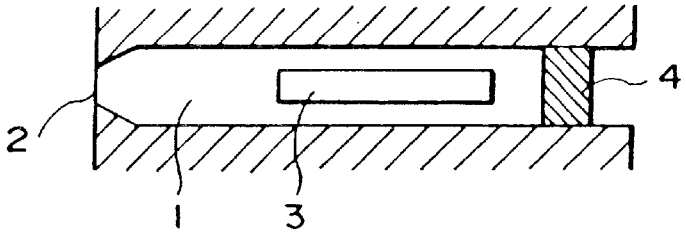
FIG. 9 is a top plan view common to FIGS. 6, 7 and 8 embodiments.

FIGS. 6, 7 and 8 show further embodiments. In FIG. 6, the flow resistance element is at a top of the ink passage; in FIG. 7, it is at the bottom; and in FIG. 8, it is in the middle. FIG. 9 is a sectional top plan view. In these embodiments, similarly to the embodiments shown in FIGS. 1–5, the bubble is divided by the flow resistance element to approximately 220 microns at the maximum bubble size time, so that the damage to the heater and the electrode due to the cavitation upon the collapse of the bubble, is reduced. Accordingly, the durability and the refilling properties are improved.

The relationship between the position of the flow resistance element and the minimum cross-sectional area of the ink flow through the flow resistance element, is as shown in Table 4. The dimensions and driving conditions are as follows:

Nozzle length: 350 microns

Nozzle cross-sectional area: 1090 micron$^2$ (substantially uniform)

Heater size: 28×133 (micron)

Distance between the ejection outlet and the heater: 120 microns

Pulse width: 3 micro-sec.

Driving voltage: 28 V

In this case, the durability was $1.3\times10^8$ pulse/nozzle, which means 30% service life increase.

TABLE 4

| Distance between heater end and resistance element (microns) | Min. area of resistance element (micron$^2$) and (% to nozzle area) |
|---|---|
| 0–20 | 414 (38%) |
| 21–50 | 327 (30%) |
| 51–70 | 196 (18%) |

The flow resistance element described in conjunction with the embodiment of FIGS. 1–3, is provided in the following nozzles A and B: Nozzle A:

Nozzle length: 320 microns
Nozzle cross-sectional area (other than the flow resistance element): 1750 $mm^2$ (315×50)
Heater size: 28×133 (microns)
The distance between the ejection outlet and the heater: 120 microns
Ejection outlet area: 1155 $micron^2$ (35×33) Nozzle B:
Nozzle length: 320 microns
Nozzle cross-section area (other than the flow resistance element): 1150 $micron^2$ (23×50)
Heater size: 28×133 (microns)
The distance between the ejection outlet and the heater: 120 microns
Ejection outlet area: 1575 $micron^2$ (23×25)

Table 5 shows the relation between the position of the flow resistance element and the upper limit of the minimum flow passage area of the flow resistance element required for dividing the bubble.

The nozzles A and B are provided with the flow resistance element shown in FIG. 2 to suppress the backwave and to improve the refilling property. The length of the flow resistance element was 20 microns. The minimum sectional area (region) of the flow resistance element has an acute angle position (90°>θ).

TABLE 5

| Distance between heater rear end and resistance | Min. area of resistance element ($micron^2$) | |
|---|---|---|
| (micron) | A | B |
| 0–20 | 1050 (60%) | 621 (54%) |
| 21–50 | 875 (50%) | 529 (46%) |
| 51–70 | 613 (35%) | 230 (20%) |

With the structure, the durability has been further improved.

The size of the bubble is influenced by the size of the heater or the like. Therefore, it is desirable that the factor is taken into account in order to divide the bubble efficiently.

When the flow resistance element is such that it limits the width of the passage, as shown in FIGS. 1–3, the width of the heater and the width of passage are significantly influential to the size of the bubble expanding in the lateral directions. So, it is desirable to determine the width of the flow resistance element at the minimum flow passage width of the flow resistance in accordance with the factor.

If the minimum width of the flow resistance is too small as compared with the heater width, it is difficult to expand the bubble to the minimum width position. If it is too large, the turbulent or eddy current is insufficient to divide the bubble. The ratio of the minimum width of the flow resistance to the heater width (H1=minimum width/heater width) is preferably not less than 60% and not more than 95% (60%≦H1≦95%), further preferably, 68%≦H1≦87%, and particularly preferably, 74%=H1≦82%.

If the minimum width of the resistance element is too large as compared with the width of the passage, it is difficult to divide the bubble efficiently, and in addition, the suppression of the back wave decreases. If it is too small, it is difficult to expand the bubble to the minimum width position. In addition, the time required for the refilling decreases. The ratio of the minimum width of the flow resistance element to the width of the passage (minimum width/ink passage width=H2) is preferably not less thus 27% and not more than 55% (27%≦H2≦55%), further preferably, 30%≦H2≦43%.

In the case of the resistance element disposed in the middle of the width of passage as shown in FIG. 4, the ink passage is divided, and therefore, preferably 70%≦H1≦90%, and further preferably 75%≦H≦87%.

The foregoing discussion is made with the width, assuming that the passage has uniform cross section, but if not, the cross-sectional area replaces the width.

The distance between the heater end and the minimum width (cross-sectional area) position, is preferably less than about 80 microns. Since the division of the bubble becomes difficult with the increase of the distance, it is preferably not more than 55 microns, and further preferably, not less than 42 microns. The lower limit is 0. But, in view of the fact that the bubble is easily divided if it is expanded toward upstream, the distance is preferably not less than 5 microns, and further preferably not less than 25 microns.

In the case of FIG. 4 structure, the upstream expansion of the bubble is strongly suppressed, and therefore, the distance is preferably about 10 microns.

The bubble is divided while it is expanding. It is desirable that the bubble is divided before the ejected ink is completely separated from the ink passage, from the standpoint of reducing the quantity of the ink required for the refilling.

The configuration of the resistance element is not limited to those described in the foregoing. It is preferable that the resistance adjacent the downward flow is smaller than that against the upstream flow, since then the back wave can be suppressed, and since then the refilling property is improved.

The resistance element may be integrally formed with the passage and may be separate element or elements mounted thereto. The resistance element may be of the same material as or a different material from, that of the passage wall, if the material is resistive against the ink. The usable materials include glass, ceramic material, plastic resin material, metal and the like.

In the foregoing, the ink passage is generally straight from the common chamber to the outlet. However, the present invention is applicable to the case of non-straight structure.

In the foregoing, the description has been made as to the improvement in the refilling properties and the improvement in the durability against the cavitation.

The description will be made as to the driving method for the recording head.

Figure 11:
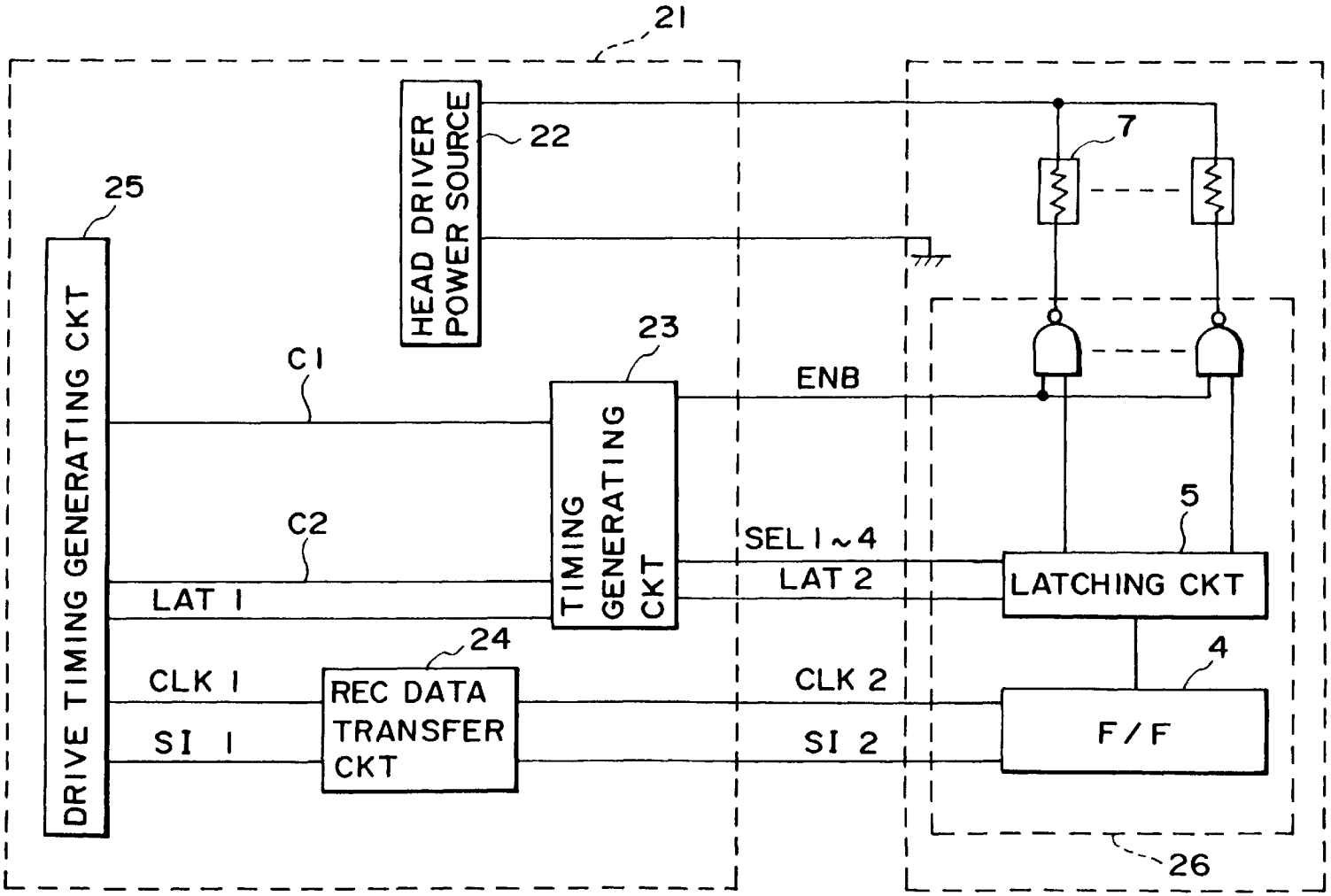
FIG. 11 is a block diagram illustrating a driving system according to an embodiment of the present invention.

FIG. 11 is a block diagram of a control system for the driving system according to this embodiment. It comprises a head driving circuit 21 according to this embodiment of the present invention, a head driver power source 22, a timing generating circuit 23, a record data transferring circuit 24, and a record data and drive timing generating circuit 25. The timing generating circuit 23 is responsive to control signals C1 and C2 from the record data and drive timing generating circuit 25 to generate a signal ENB for setting a pulse width, selection signals SEL1–SEL4 for selecting latching positions for the input record data and for selecting the electrothermal transducer elements to be driven and a latching signal LAT2. The record data transferring circuit 24 extracts and reforms the record data for one line and supplies them to the recording head driver IC 26.

Figure 12:
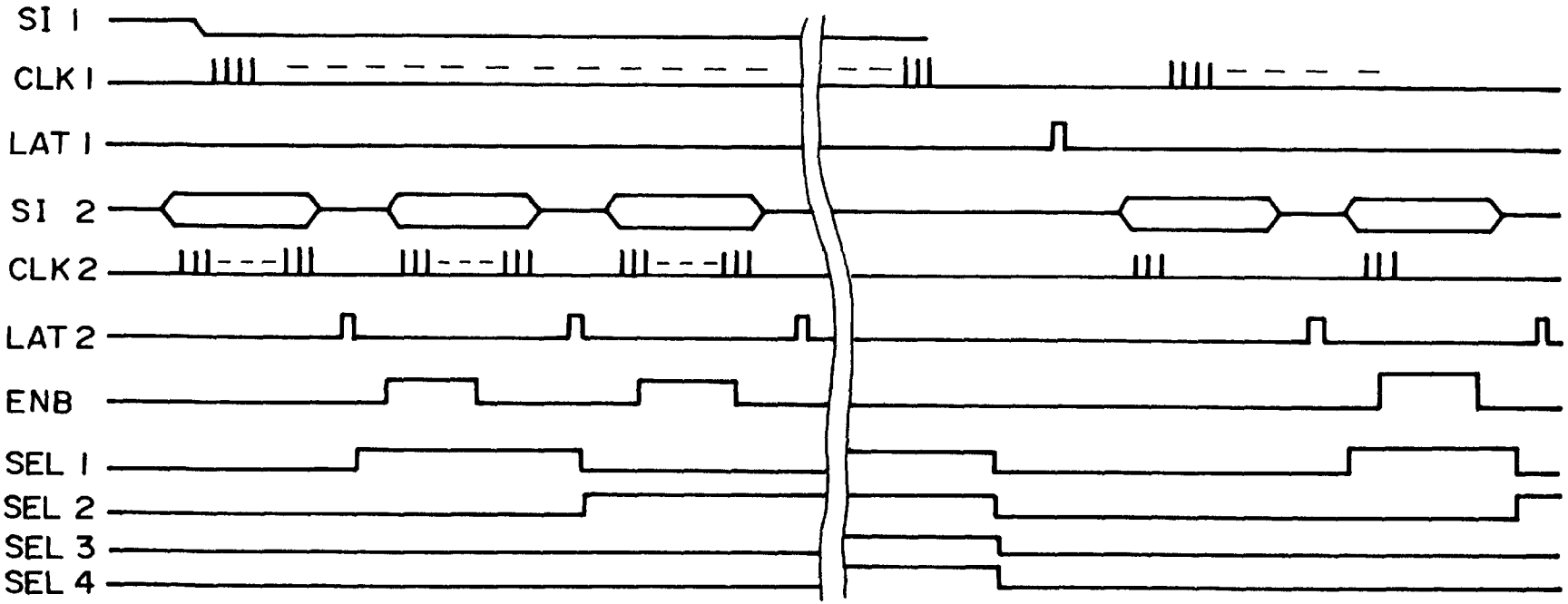
FIG. 12 is a timing chart of drive timing in an apparatus according to the present invention.

FIG. 12 shows the drive timing according to this embodiment. The record data SI1 for one line is constituted by the same number of bits as the electrothermal transducer elements. The data SI1 are reintroduced into record data SI2 which corresponds to the electrothermal transducer elements (heaters) simultaneously driven by the record data dividing and generating circuit, and then, they are transferred to the recording head. Thereafter, upon generation of the line signal LAT2, they are read in a latching circuit in the driver IC selected by the selection signals SEL1–SEL4. Then, in response to the signal ENB, the selected electrothermal transducer elements are energized. The data transfer, the selection signals and the supply of the pulse width setting signal, are repeated for a predetermined number of times, to effect the print for one line.

Figure 13B:
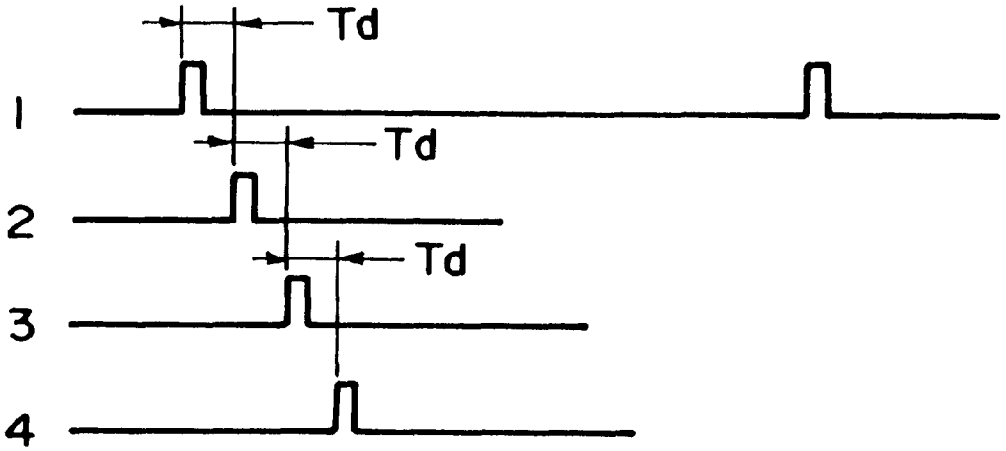
FIGS. 13A and 13B show the nozzle drives according to an embodiment of the present invention.
Figure 13A:
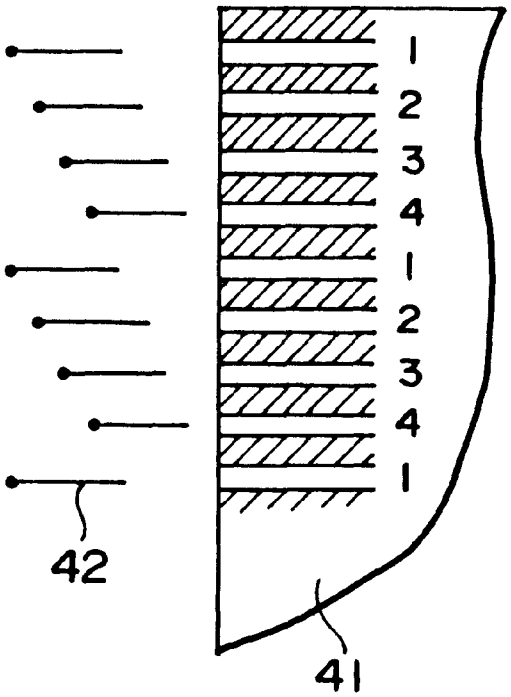

FIGS. 13A and 13B show the driving steps for each of the nozzles using the driving method according to this embodiment of the present invention. In the Figure, an ink jet recording head 41 is provided with the flow resistance element in the ink passage. The ink is ejected along a path 42. In this embodiment, the nozzles are divided into four groups No. 1, No. 2, No. 3 and No. 4. The nozzles in the groups are sequentially driven with the time difference Td, as indicated by the driving pulses in the Figure.

Figure 14:
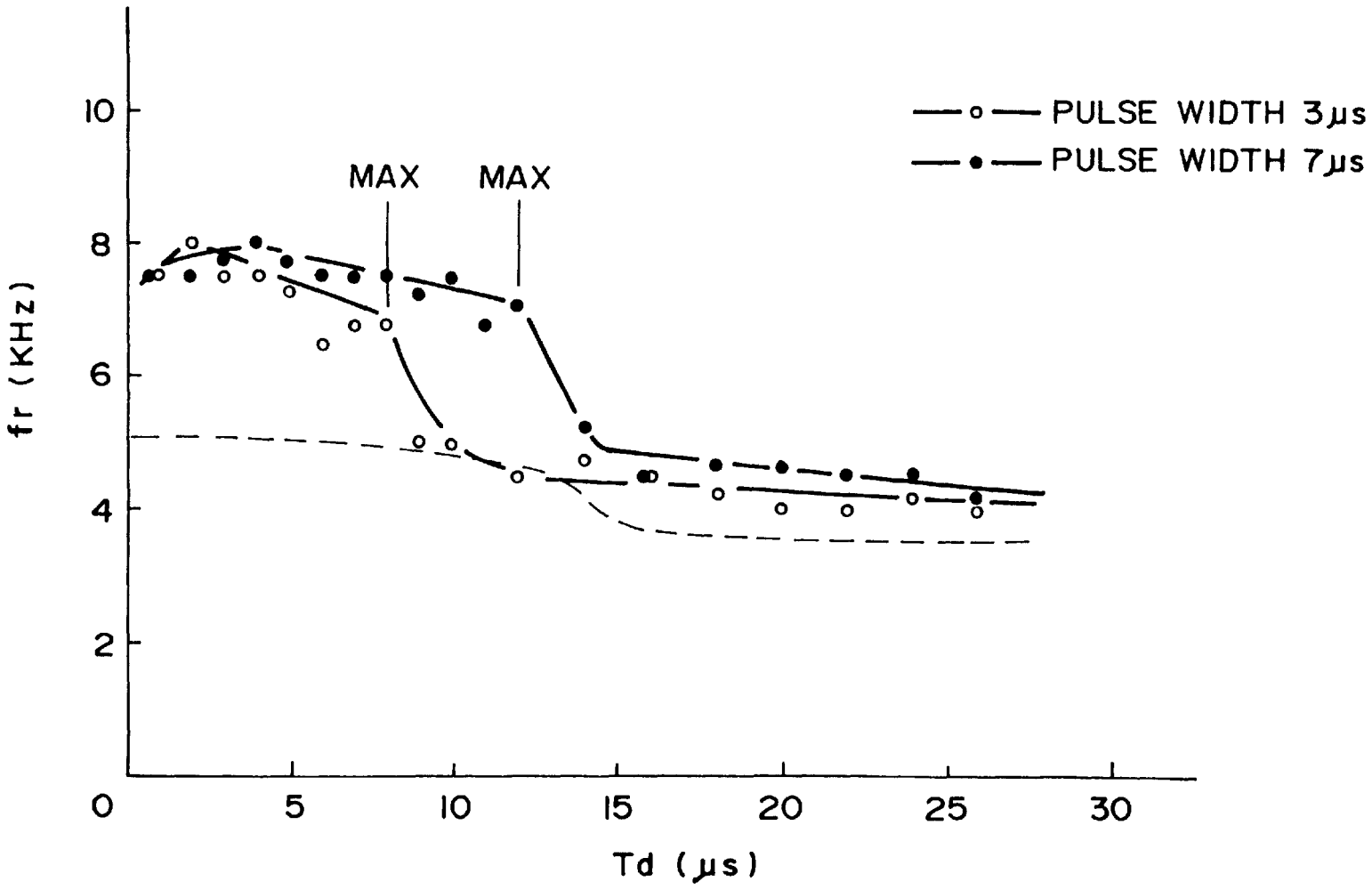
FIG. 14 is a graph showing a relation between a drive pulse time difference Td and the response frequency, in an apparatus according to an embodiment of the present invention.

FIG. 14 shows the correspondence between the driving pulse time difference Td in the grouped electrothermal transducers and the average of the response frequencies of all of the nozzles. The broken line represents the flow resistance element (pulse width w). As will be understood from this Figure, the response frequency is high within the range of Td from the start of the bubble creation to the maximum expansion thereof. Thus, it will be understood that the response frequency of each of the nozzles is improved by applying the electric pulse to the electrothermal transducers to a group of the electrothermal transducers within the period from the start of the previous bubble formation to the maximum expansion thereof. If the time difference Td is made longer than the maximum expansion of the bubble, the refilling property and therefore the response frequency is decreased. By the deviation in the liquid droplet shot position on the recording material, the print quality is degraded.

The reason why the improvement in the response frequency by the driving of the group of the nozzles before the maximum expansion of the bubbles of the previous group of the nozzle, is considered as follows. Conventionally, the application of the driving signal to the nozzle in a group is started after extinction of the bubbles in the previously actuated nozzles. However, in such a driving method, the creation of the bubbles causes the ink in a certain nozzle or nozzles in the backward direction, that is, toward the common ink chamber adjacent the nozzle in which the ink is refilled from the common chamber upon the extinction of the bubble. This produces eddy currents adjacent the ink supply port from the common chamber to the nozzles. This impedes the ink refilling. It has been found that this problem can be avoided by driving the group of nozzles before the maximum bubble expansion in the previous group nozzle actuation, because the flows of the ink from the common ink chamber to the nozzles are harmonized. Thus, the high response frequency can be provided.

If the nozzle is provided with the liquid resistance element which provides a lower impedance in the downward direction (refilling direction) than the impedance to the upward flow, the flow of the ink from the nozzles to the common chamber can be reduced sufficiently, and therefore, the response frequency can be further improved.

Figure 15:
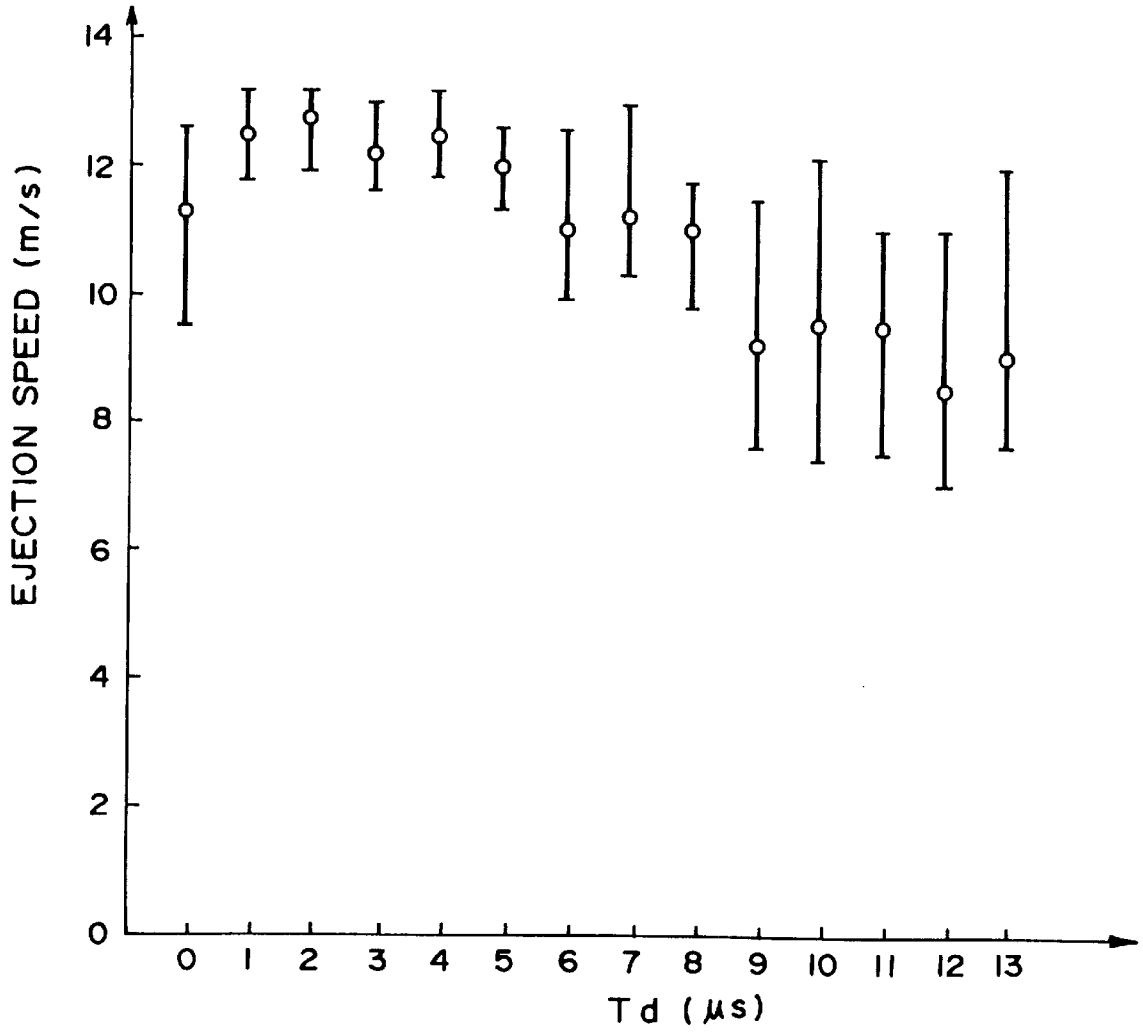
FIG. 15 shows a relation between the drive timing and the droplet ejection speed.

The inventors experiments using the recording head having 64 nozzles capable of printing at the density of 360 dpi, with the driving pulse width of 3 micro-sec, the nozzles being grouped into four 16 nozzles, operated at 6.5 KHz, it has been confirmed that if Td is out of the region of 1–5 micro-sec, the shot positions are remarkably deviated, and 8 micro-sec approximately (maximum bubble size) is the tolerable limit. The ejection droplet speeds of the nozzles under the above printing conditions is shown in FIG. 15.

It will be understood from this graph that the average ejection speed of the nozzles is as high as 12.4 mm/sec within the range of Td=1–5 micro-sec, and the variation of the ejection speeds is small. If Td≧9 micro-sec, the average ejection speed is 9.1 m/sec which is lower than the case of Td=1–5 micro-sec. In addition, the variation of the ejection speeds of the nozzles is large.

Then, it is understood that it is preferable to start the power supply to the group of nozzles before the maximum size of the bubbles in the previous group is reached and after the start of the bubble creation in the nozzles of the previous group, by which the ink ejection frequency can be made high, and the shot position accuracy is improved. Further preferably, the power supply is started within 1–5 micro-sec after the start of the bubble creation in the previous group of the nozzles.

Figure 16B:
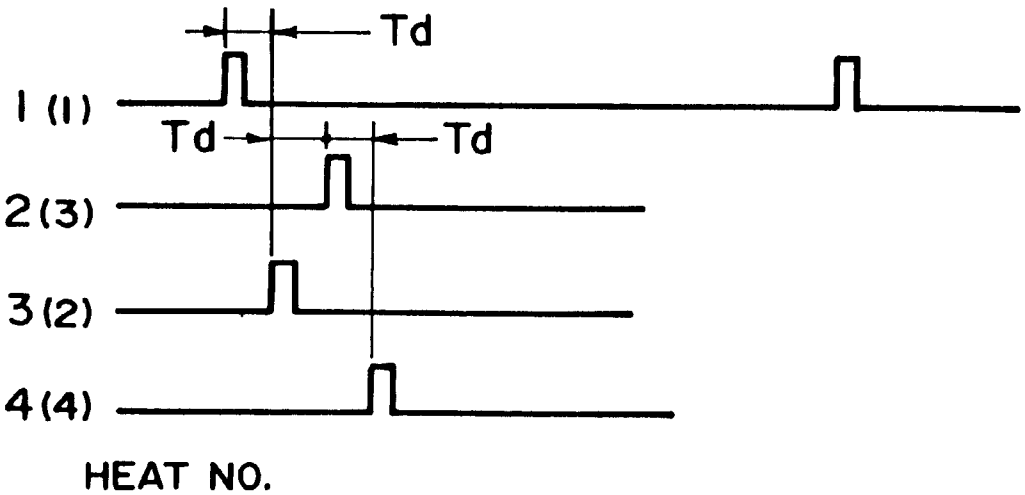
FIGS. 16A and 16B illustrate another embodiment of the present invention.
Figure 16A:
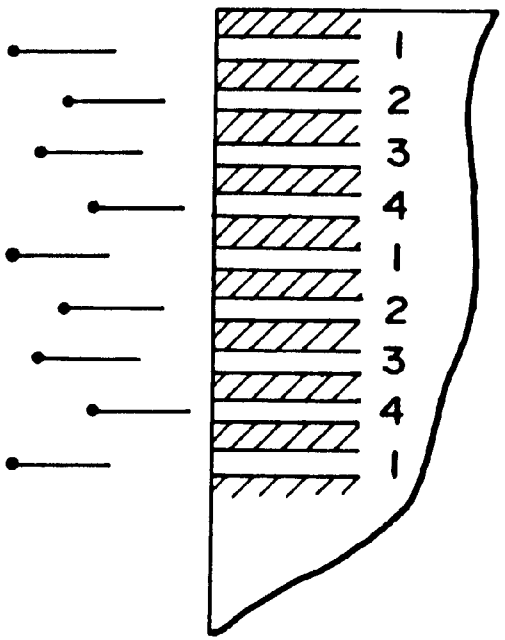

FIGS. 16A and 16B illustrate another embodiment, wherein the numerals in the parentheses show the order of the driving pulse application, that is, the driving pulse is supplied to the electrothermal transducers in the order of 1, 2, 3 and 4 in the Figure.

Figure 17B:
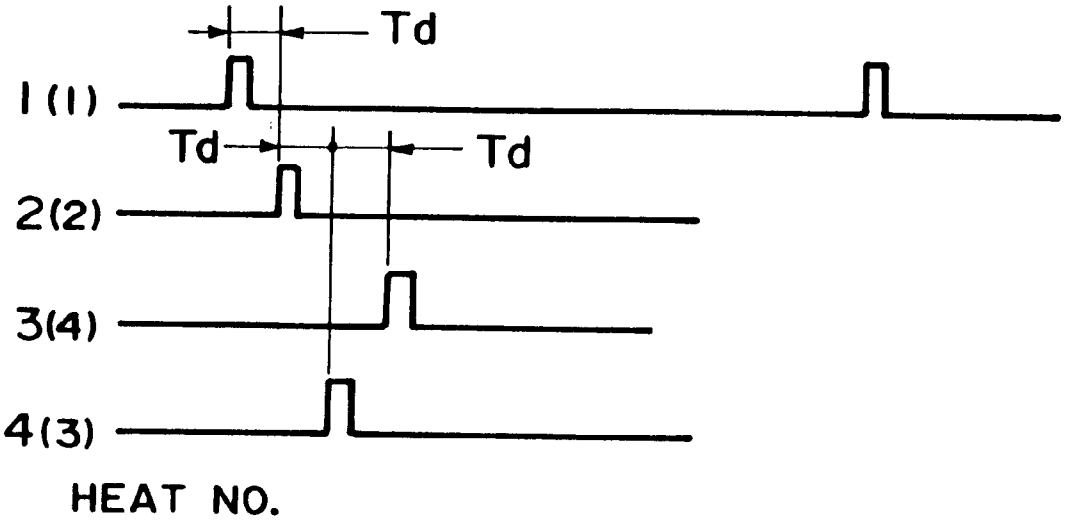
FIGS. 17A and 17B illustrate a further embodiment of the present invention.
Figure 17A:
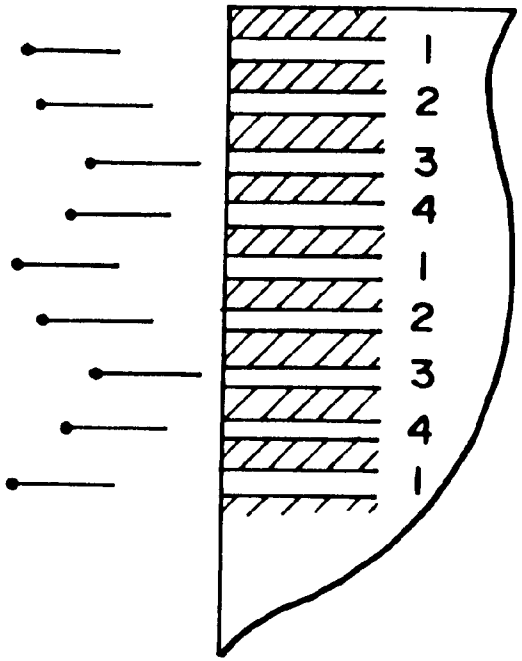

FIGS. 17A and 17B illustrate a further embodiment. In the Figure, the electrothermal transducers are supplied with the driving pulses in the order of 1, 2, 3 and 4.

In either embodiments, similarly to FIG. 4 embodiment, the refilling timing of the adjacent nozzles is synchronized as much as possible by supplying the electric energy pulse to the electrothermal transducers in a group of the nozzles within a period between the bubble creation start and the maximum size of the bubble in the nozzles of the previous group. Thus, the response frequency of the nozzle is improved, and the ejection speed is stabilized, by which the accuracy of the ink droplet shot position is improved.

The driving method is effective even when the flow resistance element is not used, as will be understood from the broken lines in FIG. 14. However, the advantageous effects are significant if the driving method is used with the nozzle having the flow resistance element.

Figure 18:
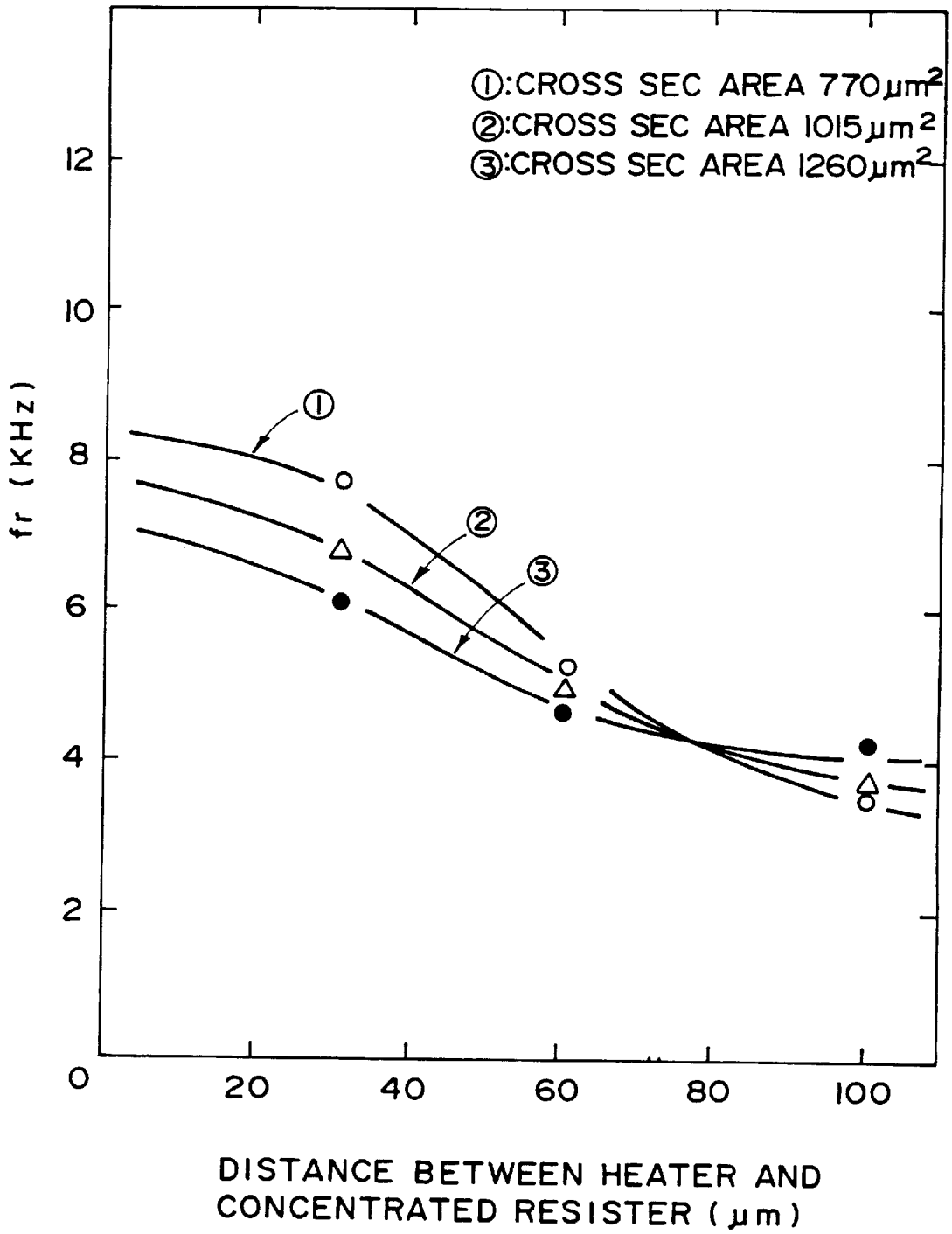
FIG. 18 shows a relation between a position of the flow resistance and the response frequency in a nozzle using the driving method according to an embodiment of the present invention.

FIG. 18 shows the position of the flow resistance element (the distance between the heater and the converging flow resistance element) and the response frequency, when the driving method of the present invention is used. As shown in the Figure, with the decrease of the distance of the flow resistance element from the heater, the response frequency can be increased. The advantage is significant in the recording head in which the created bubble can be divided by the small cross-sectional passage area of the flow resistance element.

Figure 19:
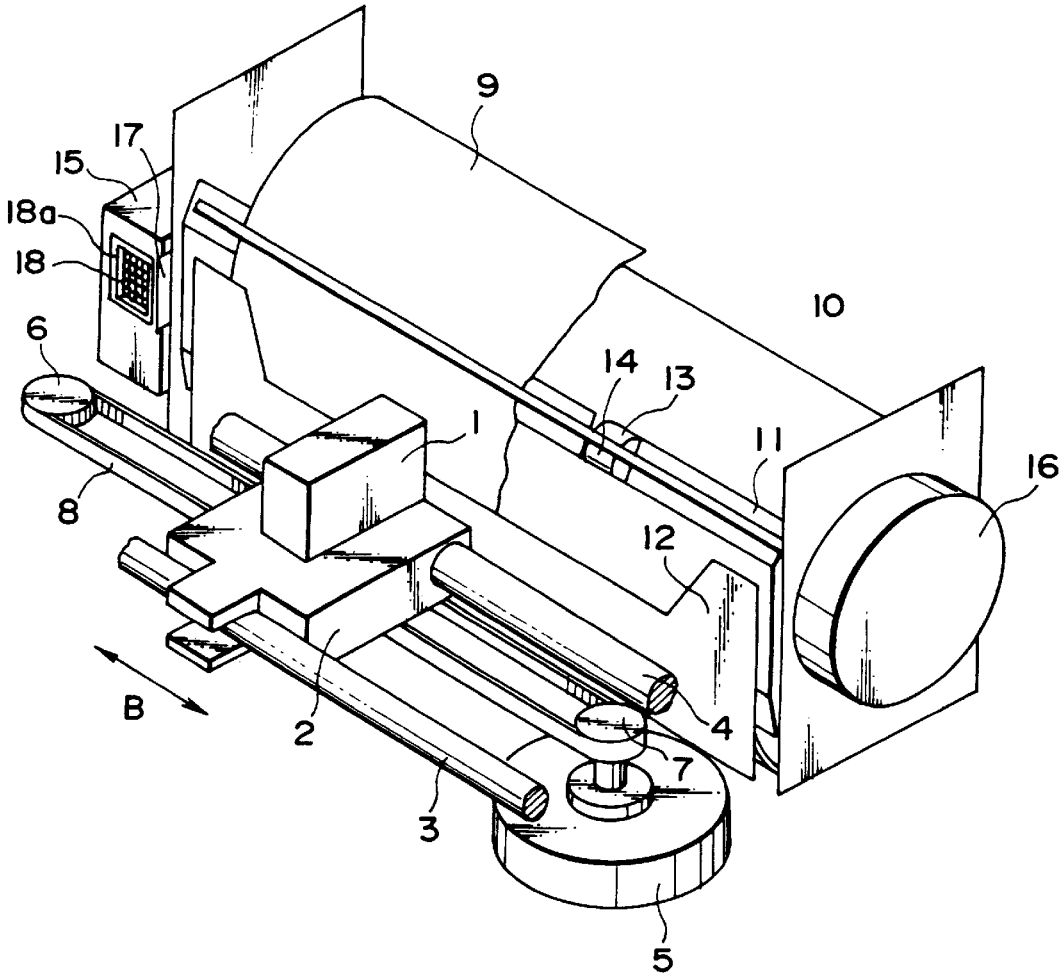
FIG. 19 is a perspective view of an example of a recording apparatus according to an embodiment of the present invention.

FIG. 19 is a perspective view of an ink jet recording apparatus having the recording head according to the present invention and using the driving method according to the present invention. It comprises an ink jet recording head for providing a desired image by ejection of the ink in accordance with recording signals, a scanning carriage 2 carrying the recording head 1 and movable in a recording direction (main scanning direction), and guiding shafts 3 and 4 for slidably supporting the carriage. The carriage is reciprocated by a timing belt 8 in the main scan direction along the guiding shafts 3 and 4. The timing belt 8 engaged with the pulleys 6 and 7 is driven by a carriage motor 5 through a pulley 7.

The recording sheet 9 is guided by a paper pan 10 and is fed by cooperation of a feeding roller not shown and a pinch roller. The feeding roller is driven by a sheet feeding motor 16. The fed recording paper or sheet 9 is stretched by a sheet discharging roller 13 and a spurs 14, and is press-contacted to a heater 11 by a sheet confining plate 12 made of an elastic material, and therefore, the sheet is fed while being in contact with the heater 11. The recording sheet 9 now having the ink deposited thereon from the recording head 1 is heated by the heater 11, and the solvent of the ink is evaporated, so that the ink is fixed on the recording sheet. The heat-fixing by the heater 11 is not inevitable, but may be omitted, depending on the property of the ink or the like.

The recording apparatus comprises a recovery unit 15 which functions to restore the ejection property of the recording head by removing the foreign matter of the high viscosity residual ink deposited in the ejection outlets.

A cap 18*a* is a part of the recovery unit 15 and functions to cap the ejection outlets of the ink jet recording head 1 to prevent the nozzles from clogging. The cap 18*a* is provided with an ink absorbing material 18.

In the recording range side of the recovery unit 15, a cleaning blade 17 is provided which is contactable to the ejection outlet side surface of the recording head 1 to remove the foreign matter or the ink droplets deposited on the ejection side surface.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the improved ink passages are provided, by which the bubble created is divided so that the maximum length of the bubble can be reduced, so that the damage to the heater, electrode and/or the ink passage due to the cavitation upon the collapse of the bubble can be reduced. Therefore, the durability of the recording head can be improved. In addition, the driving frequency of the recording head can be increased.

According to the driving method of the present invention, the frequency of the liquid ejection can be improved, so that the recording speed can be increased.

In addition, the variation in the ejection speeds of the liquid droplets ejected through the nozzles can be minimized, thus stabilizing the ejection speed, improving the accuracy in the droplet shot positions, and therefore, improving the print quality.

While the invention has been described with reference to the structures disclosed herein, it is not confined to the details set forth and this application is intended to cover such modifications or changes as may come within the purposes of the improvements or the scope of the following claims.

What is claimed is:

1. A method of collapsing a bubble in an ink jet recording head, said method comprising the steps of:

providing the ink jet recording head, said recording head comprising:

an ejection outlet, an ink passage corresponding to the ejection outlet, a thermal energy generating means for heating the ink in said ink passage to create a bubble, and a flow resistance element provided corresponding to the ink passage, said flow resistance element being not provided on a surface having said thermal energy generating means but provided on a surface opposed to the surface having said thermal energy generating means;

driving said thermal energy generating means to create the bubble in the ink passage and to divide the generated bubble using said flow resistance element to promote collapse of the bubble.

2. An ink jet recording apparatus, comprising:

an ink jet recording head comprising a plurality of ejection outlets, a plurality of ink passages each corresponding to an associated said ejection outlet, and a plurality of thermal energy generating means each for heating the ink to create a bubble;

control means for driving said plurality of thermal energy generating means, said thermal energy generating means having been grouped into a plurality of groups; and driving means for supplying signals for each of the groups of the thermal energy generating means before a bubble created by another said group of said thermal energy means previously supplied with signals expands to a maximum size.

* * * * *

UNITED STATES PATENT AND TRADEMARK OFFICE

CERTIFICATE OF CORRECTION

PATENT NO. : 6,439,692 B1
DATED : August 27, 2002
INVENTOR(S) : Yoshinori Misumi It is certified that error appears in the above-identified patent and that said Letters Patent is hereby corrected as shown below:

Title page,
Item [56], References Cited, FOREIGN PATENT DOCUMENTS,
"0100169" should read -- 55-100169 --.
"0037438" should read -- 61-37438 --.

Drawings,
Sheet 11, Figure 18, "RESISTER" should read -- RESISTOR --.

Column 1,
Line 11, "693 which" should read -- 693, which --;
Line 23, "function" should read -- functions --; and
Line 45, "instable" should read -- unstable --.

Column 2,
Line 52, "reduced," should read -- be reduced, --; and
Line 66, "is" should read -- are --.

Column 3,
Line 1, "is" should read -- are --; and
Line 22, "top" should read -- a top --.

Column 5,
Line 27, "efficiency" should read -- efficiently --; and
Line 34, "increase" should read -- increases --.

Column 6,
Line 67, "Nozzle" should read -- ¶ Nozzle --.

Column 7,
Line 6, "Nozzle" should read -- ¶ Nozzle --; and
Line 8, "cross-section" should read -- cross-sectional --.

Column 8,
Line 24, "is" should read -- be --.

UNITED STATES PATENT AND TRADEMARK OFFICE

CERTIFICATE OF CORRECTION

PATENT NO. : 6,439,692 B1
DATED : August 27, 2002
INVENTOR(S) : Yoshinori Misumi It is certified that error appears in the above-identified patent and that said Letters Patent is hereby corrected as shown below:

Column 9,
Line 57, "The inventors" should read -- In the inventors'--; and
Line 65, "is" should read -- are --.

Column 12,
Line 2, "and" should read -- or --;
Line 3, "head" should read -- heads --;
Line 22, "recording head mountable," should read -- mountable recording head, --;
Line 40, "is" (first occurrence) should read -- of --;
Line 41, "applicable" should read -- applied --;
Line 47, "producing" should read -- produces --; and
Line 56, "is faced to" should read -- faces --.

Column 14,
Line 5, "means" should read -- means; and --.

Signed and Sealed this

Twenty-third Day of September, 2003

JAMES E. ROGAN
*Director of the United States Patent and Trademark Office*